US011111828B2

(12) United States Patent
Von Gaisberg-Helfenberg et al.

(10) Patent No.: US 11,111,828 B2
(45) Date of Patent: Sep. 7, 2021

(54) VALVETRAIN FOR AN INTERNAL COMBUSTION ENGINE, IN PARTICULAR OF A MOTOR VEHICLE

(71) Applicant: Daimler AG, Stuttgart (DE)

(72) Inventors: Alexander Von Gaisberg-Helfenberg, Beilstein (DE); Thomas Stolk, Kirchheim (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/963,025

(22) PCT Filed: Dec. 12, 2018

(86) PCT No.: PCT/EP2018/084481
§ 371 (c)(1),
(2) Date: Jul. 17, 2020

(87) PCT Pub. No.: WO2019/141444
PCT Pub. Date: Jul. 25, 2019

(65) Prior Publication Data

US 2020/0355099 A1 Nov. 12, 2020

(30) Foreign Application Priority Data

Jan. 19, 2018 (DE) ..... 10 2018 000 435.0

(51) Int. Cl.
*F01L 13/00* (2006.01)
*F01L 1/053* (2006.01)
*F01L 1/047* (2006.01)

(52) U.S. Cl.
CPC ..... *F01L 13/0042* (2013.01); *F01L 1/053* (2013.01); *F01L 2001/0473* (2013.01);
(Continued)

(58) Field of Classification Search
CPC ..... F01L 2001/0473; F01L 1/053; F01L 1/46; F01L 2013/0052; F01L 2013/103; F01L 2820/032
(Continued)

(56) References Cited

U.S. PATENT DOCUMENTS

2013/0263809 A1 10/2013 Ozeki
2016/0265397 A1* 9/2016 Schulz ..... F01L 13/0036

FOREIGN PATENT DOCUMENTS

DE 10 2007 037 746 A1 2/2009
DE 10 2014 217 584 A1 3/2016
(Continued)

OTHER PUBLICATIONS

PCT/EP2018/084481, International Search Report dated Mar. 15, 2019 (Two (2) pages).
(Continued)

*Primary Examiner* — Jorge L Leon, Jr.
(74) *Attorney, Agent, or Firm* — Crowell & Moring LLP

(57) ABSTRACT

A valvetrain for an internal combustion engine has a camshaft that can be rotated in a direction of rotation around an axis of rotation, at least two cam pieces arranged on the camshaft which each have at least two cams for actuating a respective gas exchange valve and which are rotationally fixedly connected to the camshaft, and an actuator via which the cam pieces can be shifted in the axial direction of the camshaft. A first of the cam pieces has a first rib protruding outwardly from a first base body of the first cam piece in the radial direction of the camshaft and the second cam piece has a second rib protruding outwardly from a second base body of the second cam piece in the radial direction of the camshaft.

8 Claims, 2 Drawing Sheets

(52) U.S. Cl.
CPC . *F01L 2013/0052* (2013.01); *F01L 2013/103* (2013.01); *F01L 2820/032* (2013.01)

(58) Field of Classification Search
USPC ..... 123/90.18, 90.27
See application file for complete search history.

(56) References Cited

FOREIGN PATENT DOCUMENTS

| | | | |
|---|---|---|---|
| DE | 10 2015 011 545 | A1 | 4/2016 |
| DE | 10 2015 012 044 | A1 | 3/2017 |
| DE | 10 2016 001 537 | A1 | 5/2017 |
| DE | 10 2018 012 193 | A1 | 4/2018 |
| DE | 10 2017 003 789 | A1 | 10/2018 |

OTHER PUBLICATIONS

German-language German Office Action issued in German application No. 10 2018 000 435.0 dated Aug. 9, 2019 (Six (6) pages).

* cited by examiner

VALVETRAIN FOR AN INTERNAL COMBUSTION ENGINE, IN PARTICULAR OF A MOTOR VEHICLE

BACKGROUND AND SUMMARY OF THE INVENTION

The invention relates to a valvetrain for an internal combustion engine, in particular of a motor vehicle.

Such a valvetrain for an internal combustion engine, in particular of a motor vehicle, is already known from DE 10 2007 037 746 A1. The valvetrain comprises at least one camshaft that can be rotated around an axis of rotation in a direction of rotation and at least two cam pieces arranged on the camshaft, which each have at least two cams for actuating a respective gas exchange valve and are rotationally fixedly connected to the camshaft. Thus, the cam pieces can be driven via the camshaft and can thus be rotated around the axis of rotation in the direction of rotation. Moreover, an actuator is provided by means of which the cam pieces can be shifted in the axial direction of the camshaft in relation to it.

The object of the present invention is to further develop a valvetrain of the kind mentioned above in such a way that the installation space requirement of the valvetrain can be kept particularly minimal.

In order to develop a valvetrain of the kind specified herein in such a way that the installation space requirement of the valvetrain can be kept particularly minimal, it is provided according to the invention that a first of the cam pieces has a first rib outwardly protruding from a first base body of the first cam piece in the radial direction of the camshaft, the rib extending along the direction of rotation in a or across a first angle region of the first cam piece or the camshaft. The second cam piece has a second rib outwardly protruding from a second base body of the second cam piece in the radial direction of the camshaft, the rib extending along the direction of rotation in a or across a second angle region of the second cam piece attached to the first angle region.

Here, the actuator common to the cam pieces is coupled to the first cam piece via the first rib during a respective first part of a respective rotation of the camshaft and decoupled from the second cam piece, such that, in particular during the respective first part or while the first cam piece is coupled to the actuator via the first rib, the first cam piece can be shifted via the first rib by means of the actuator, while a shifting of the second cam piece caused by the actuator ceases. Moreover, the actuator is coupled to the second cam piece via the second rib during a respective second part of the respective rotation of the camshaft following on from the first part and is decoupled from the first cam, such that, in particular while the second cam shaft is coupled to the actuator via the second rib or during the second part, the second cam piece can be shifted via the second rib by means of the actuator, while a shifting of the first cam piece caused by the actuator ceases.

In relation to the second cam piece or the second rib, the first part of the respective rotation is a first decoupling phase, since the actuator is decoupled from the second rib and thus from the second cam piece during the respective first part. In relation to the first cam piece or in relation to the first rib, the second part is a second decoupling phase, since the actuator is decoupled from the first rib and thus from the first cam piece during the respective decoupling phase. Thus, the actuator is decoupled from the respective rib and thus from the respective cam piece during the respective decoupling phase, such that a mechanical forced decoupling is provided. During an operation of the internal combustion engine formed, for example, as a reciprocating piston engine, the camshaft carries out several successive and complete rotations, for example, wherein each rotation respectively has the first part and the second part. Thus, the actuator is periodically mechanically forcibly decoupled from the respective cam piece during the operation. However, in the decoupling phase, a switching process can be at least introduced or carried out, since the actuator is coupled to one of the cam pieces in the decoupling phase, the cam piece being able to be correspondingly shifted by means of the actuator.

Since guide tracks or guide connecting links that are provided, for example, on the cam pieces and into which a pin of the actuator, for example, would have to engage, are not used to cause the shifting of the cam pieces, but since the ribs outwardly protruding in the radial direction are used to cause the shifting of the cam pieces, whose thickness running in the axial direction of the camshaft can be kept particularly minimal, the installation space requirement of the valvetrain according to the invention can be kept particularly minimal. In other words, the ribs formed, for example, as crescent ribs or as crescent-shaped ribs, can be designed to be very narrow in the axial direction, such that the ribs require a very minimal installation space on the camshaft. As a result, the valvetrain according to the invention can also be used, for example, for such internal combustion engines and, in particular, in cylinder heads of such internal combustion engines, which have a very small cylinder spacing. Moreover, a production that is laborious in terms of time and cost of guide tracks, also called switching connecting links, in the cam pieces can be avoided, such that the valvetrain according to the invention can be produced cost-effectively. At the same time, a valve stroke switch according to the so-called sliding cam principle can be realized by means of the valvetrain according to the invention, since the cam pieces can be shifted in the radial direction of the camshaft in relation to this in order to thus be able to switch between different valve strokes, for example.

In order to be able to keep the installation space requirement, the costs and the weight of the valvetrain particularly low, it is provided in a further embodiment of the invention that a third angle region, attached to the first angle region in the direction of rotation, of the first cam piece is free from the first rib, wherein a fourth angle region, attached to the second angle region in the direction of rotation, of the second cam piece is free from the second rib. This means that the first rib does not run into or is not arranged in the third angle region, wherein the second rib does not run or is not arranged in the fourth angle region.

A further embodiment is characterized in that the respective cam piece can be shifted between a respective first position and a respective second position. In the first position of the first cam piece, a first gas exchange valve is actuated, for example, by means of a first of the cams of the first cam piece, in particular when the camshaft is rotated around the axis of rotation. In the second position of the first cam piece, the first gas exchange valve, for example, is actuated by means of the second cam of the first cam piece, wherein the first cam and the second cam of the first cam piece are different from each other by means of a respective stroke of the first gas exchange valve that can be caused by means of the cams of the first cam piece and also referred to as the valve stroke.

In the first position of the second cam piece, a second gas exchange valve, for example, is actuated by means of the first of the cams of the second cam piece. In the second position of the second cam piece, the second gas exchange valve, for example, is actuated by means of the second cam of the second cam piece, wherein the cams, for example, of the second cam piece differ from one another in that strokes that differ from one another and are also called valve strokes of the second gas exchange valve can be caused by means of the cams of the second cam piece. In this way, a valve stroke switching can be achieved by shifting the cam pieces.

In principle, it is conceivable that the first cam piece, for example, is shifted out of the first position into the second position or vice versa by means of the actuator inside a first rotation of the camshaft, wherein the second cam piece is shifted out of the first position into the second position or vice versa inside a second rotation following the first rotation by means of the actuator.

However, it has been shown to be particularly advantageous when both the first cam piece and the second cam piece can be shifted out of the respective first position into the respective second position or vice versa by means of the actuator inside the same rotation. Thus, a valve stroke switching, for example, for the first gas exchange valve and for the second gas exchange valve can be realized within the same rotation, such that a particularly advantageous operation can be depicted in a manner saving installation space.

In order to keep the installation space requirement as minimal as possible, it is provided in a further embodiment of the invention that the ribs are arranged on a common first plane running perpendicularly to the axial direction of the camshaft, when the cam pieces are simultaneously in the first positions. Furthermore, the ribs are arranged on a common second plane running perpendicularly to the axial direction of the camshaft and spaced apart from the first plane in the axial direction, when the cam pieces are simultaneously in the second positions. In doing so, the installation space requirement can be kept minimal.

A further embodiment is characterized in that the valvetrain has a first form-fit element and a second form-fit element, which can be shifted by means of the actuator in a movement direction running in parallel to the axial direction. When the cam pieces are simultaneously in the first positions, the first rib, during the first part, and the second rib, during the second part of the rotation, interact in a form-fit manner with the first form-fit element, and a form-fit interaction of the ribs with the second form-fit element ceases during the rotation. During the rotation, both the first rib and the second rib, for example, thus engage in the first form-fit element during the respective parts, wherein an engagement of the ribs in the second form-fit element ceases during this rotation.

When the cam pieces are simultaneously in the second positions, the first rib, during the first part, and the second rib, during the second part, interact in a form-fit manner with the second form-fit element, and a form-fit interaction of the ribs with the first form-fit element ceases during the rotation. Thus, for example during the rotation, the ribs engage in a form-fit manner in the second form-fit element, wherein, during this rotation, an engagement of the ribs in the first form-fit element ceases. If, for example, the first cam piece is in its first position, while the second cam piece is simultaneously in its second position, then the first rib interacts with the first form-fit element during the first part, the second rib interacts with the second form-fit element during the second part, a form-fit interaction of the first rib with the second form-fit element ceases during the rotation, and a form-fit interaction of the second rib with the first form-fit element ceases during the rotation. In doing so, a particularly adequate valve stroke switch can be realized in a manner saving installation space.

In order to keep the number of parts, the weight and the installation space requirement in a particularly low range, it is provided in a further embodiment of the invention that the cam pieces can be shifted both in a first direction and in a second direction opposite to the first direction via the ribs by means of the actuator. Thus, the cam pieces can be moved, in particular shifted, from the respective first position into the respective second position and back from the respective second position into the respective first position by means of one and the same actuator.

In a particularly advantageous embodiment of the invention, the actuator common to the cam pieces has an engine common to the cam pieces, by means of which engine the cam pieces can be shifted via the ribs. As part of the invention, the engine is generally to be understood to mean a device or machine, which converts a type of energy into kinetic energy to shift the cam pieces, for example, and, in doing so, performs mechanical work, by means of which the respective cam piece can be shifted or is shifted. Here, the engine is an electric engine and thus can be operated electrically, such that the type of energy mentioned above is electrical energy. However, the engine can alternatively be formed as a pneumatic or hydraulic engine. The idea underlying this embodiment is to allocate the cam pieces that are formed separately from one another and can be shifted relative to one another to the engine common to the cam pieces, such that exactly one engine is provided for shifting the cam pieces. The knowledge underlying this embodiment is that one actuator and thus one engine is conventionally provided per cam piece, such that two actuators and two engines are provided when using two cam pieces. However, according to the invention, it is now provided to shift the two cam pieces by means of one and the same actuator or by means of one and the same engine, whereby the installation space requirement can be kept within a particularly low range.

A particularly advantageous embodiment is characterized in that the form-fit elements and, via these, the cam pieces can be shifted by means of the engine in the first direction and in the second direction, whereby the cam pieces can be shifted from the respective first position into the respective second position and from the respective second position into the respective first position by means of the engine. Thus, a particularly compact construction of the valvetrain can be realized.

Finally, it has been shown to be particularly advantageous when the angle region is greater than 90 degrees, in particular greater than 100 degrees and preferably greater than 120 degrees. Preferably, the angle region is greater than 160 degrees, in particular greater than 170 degrees, wherein the angle region is preferably at most 180 degrees, in particular at most 179 degrees. In doing so, a sufficiently long period of time is available during the respective rotation of the camshaft in order to shift the respective cam piece within the respective rotation, in particular in order to shift the two cam pieces within the respective rotation.

Further advantages, features and details of the invention emerge from the description below of a preferred exemplary embodiment and by means of the drawings. The features and feature combinations mentioned above in the description and the features and feature combination mentioned below in the description of the Figures and/or shown only in the Figures can be used not only in the respectively specified combination, but also in other combinations or individually without leaving the scope of the invention.

DETAILED DESCRIPTION OF THE DRAWINGS

Figure 1:
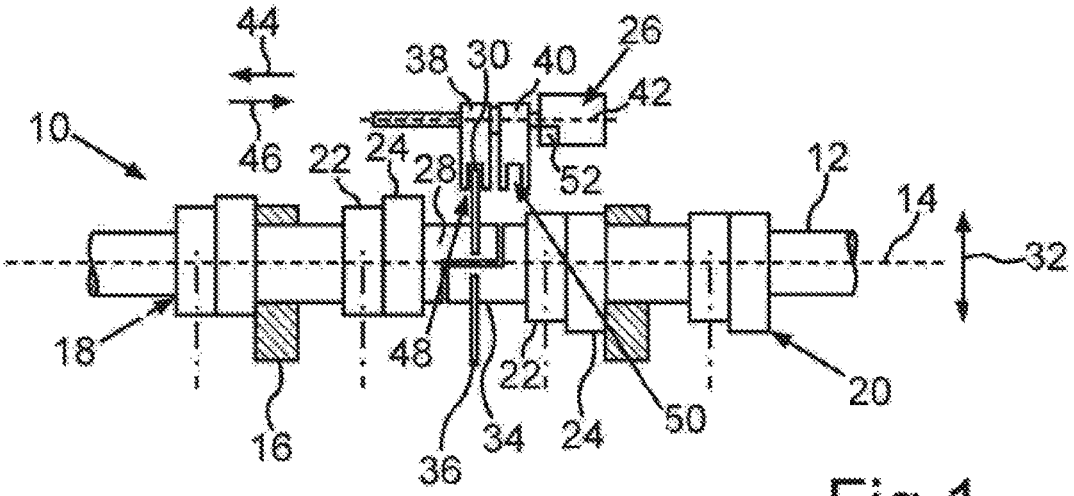
FIG. 1, sectionally, is a schematic side view of a valvetrain according to the invention, wherein cam pieces of the valvetrain are in their first positions.

In the Figures, the same or functionally identical elements are provided with the same reference numerals.

Sectionally in a schematic side view, FIG. 1 shows a valvetrain 10 for an internal combustion engine of a motor vehicle, in particular a motor vehicle formed, for example, as a passenger vehicle. The internal combustion engine is formed as a reciprocating piston engine and has at least one or more combustion chambers, wherein the respective combustion chamber is formed, in particular, as a cylinder. At least one gas exchange valve is allocated to the respective cylinder, the gas exchange valve being able to be moved translationally between a respective closed position and at least two open positions different from one another. The respective gas exchange valve can be actuated by means of the valvetrain 10 and can thus be translationally moved from the closed position into the respective open position. To do so, the valvetrain 10 comprises a camshaft 12 also called the wave element, which can be rotated around an axis of rotation 14 in a direction of rotation. In the completely constructed state of the internal combustion engine, the camshaft 12 is rotatably mounted on a cylinder head 16, for example, that can be seen sectionally in FIG. 1 and thus can be rotated around the axis of rotation 14 relative to the cylinder head 16. The valvetrain 10 furthermore comprises two cam pieces 18 and 20 arranged on the camshaft 12 and shiftable in the axial direction of the camshaft 12 relative to it, which cam pieces respectively have at least two cams 22 and 24. Here, the cams 22 and 24 of the cam piece 18 are allocated to a first of the gas exchange valves, wherein the cams 22 and 24 of the cam piece 20 are allocated to a second of the gas exchange valves. This means that the first gas exchange valve can be alternatingly actuated by means of the cams 22 and 24 of the cam piece 18, wherein the second gas exchange valve can be alternatingly actuated by means of the cams 22 and 24 of the cam piece 20. The cam pieces 18 and 20 are rotationally fixedly connected to the camshaft 12 and can thus be rotated with this around the axis of rotation 14 relative to the cylinder head 16.

The valvetrain 10 further comprises an actuator 26 common to the cam pieces 18 and 20 by means of which the cam pieces 18 and 20 can be shifted in the axial direction of the camshaft 12 relative to the camshaft 12. The axial direction of the camshaft 12 here coincides with the axis of rotation 14. The respective cam piece 18 or 20 can be shifted in the axial direction of the camshaft 12 relative to this between a respective first position shown in FIG. 1 and a respective second position shown in FIG. 4. In the first position of the cam piece 18, the first gas exchange valve is actuated by means of the cam 22 of the cam piece 18 when the camshaft 12 and thus the cam pieces 18 and 20 are rotated around the axis of rotation 14. In the second position of the cam piece 18, the first gas exchange valve is actuated by means of the cam 24 of the cam piece 18 when the camshaft 12 is rotated around the axis of rotation 14.

As a result, in the first position of the cam piece 20, the second gas exchange valve is actuated by means of the cam 22 of the cam piece 20, wherein, in the second position of the cam piece 20, the second gas exchange valve is actuated by means of the cam 24 of the cam piece 20. A respective first stroke of the respective gas exchange valve is caused or can be caused by means of the respective cam 22. A respective second stroke of the respective gas exchange valve can be caused or is caused by means of the respective cam 24. Here, the second stroke, for example, is greater than the first stroke, such that the respective gas exchange valve can be opened or is opened further by means of the respective cam 24 than by means of the respective cam 22. The respective gas exchange valve here carries out the respective stroke on its way out of the respective closed position into the respective open position. By carrying out the respective first stroke, the respective gas exchange valve reaches a first of the open positions out of the respective closed position, wherein the respective gas exchange valve reaches the respective second position from the respective closed position by carrying out the respective second stroke. Since the second stroke is greater than the first stroke, the respective first open position is between the closed position and the respective second open position.

Since the different strokes can be moved by means of the cams 22 and 24, a valve stroke switch can be achieved by shifting the respective cam piece 18 or 20 into the respective positions, whereby an efficient and effective operation of the internal combustion engine can be achieved. In order to now be able to keep the installation space requirement of the valvetrain 10 particularly minimal, the cam piece 18 also called the first cam piece has a first rib 30 protruding outwardly from a first base body 28 of the cam piece 18 in the radial direction of the camshaft 12, the rib extending in the direction of rotation into a or across a first angle region of the first cam piece 18. The radial direction of the camshaft 12 runs perpendicularly to the axial direction and is illustrated in FIG. 1 by a double arrow 32. The cam piece 20 also called the second cam piece has a second rib 36 protruding outwardly from a second base body 34 of the cam piece 20 in the radial direction of the camshaft 12, the rib extending in the direction of rotation in a or across a second angle region, attached to the first angle region, of the second cam piece 20. The respective rib 30 or 36 is, for example, shaped like an arc and here is formed, in particular, to be crescent-shaped, such that the respective angle region in the peripheral direction, coinciding with the direction of rotation, of the respective cam piece 18 or 20 or in the peripheral direction of the camshaft 12 is less than 360 degrees and at most 180 degrees, in particular at most 179 degrees.

The actuator 26 is an actuator common to the cam pieces 18 and 20, such that both the cam piece 18 and the cam piece 20 can be shifted out of the respective first position into the respective second position and out of the respective second position into the respective first position by means of the actuator 26. The actuator 26 common to the cam pieces 18 and 20 is coupled in a form-fit manner to the first cam piece 18 via the first rib 30 during a respective first part of a respective rotation of the cam shaft 12 and decoupled from the second cam piece 20, such that—while the actuator is coupled to the cam piece 18 via the rib 30 and decoupled from the cam piece 20—the first cam piece 18 can be shifted via the first rib 30 by means of the actuator 26, while a shifting of the second cam piece 20 caused by the actuator 26 ceases.

During a respective second part, following the first part, of the respective rotation of the camshaft 12, the actuator 26 is coupled to the second cam piece 20 via the second rib 36 and decoupled from the first cam piece 18, such that—while the actuator 26 is coupled to the second cam piece 20 via the rib 36 and decoupled from the first cam piece 18—the second cam piece 20 can be shifted via the second rib 36 by means of the actuator 26, while a shifting of the first cam piece 18 caused by the actuator 26 ceases.

Here, the valvetrain 10 has a first form-fit element 38 and a second form-fit element 40, which is arranged next to the form-fit element 38 in a movement direction 42 running in parallel to the axial direction. The form-fit elements 38 and 40 can here be translationally moved in the movement direction 42 by means of the actuator 26, wherein the form-fit elements 38 and 40 can be translationally moved, i.e., shifted, in a first direction illustrated by an arrow 44 and coinciding with the movement direction and in a second direction illustrated in FIG. 1 by an arrow 46, coinciding with the movement direction and in opposition to the first direction. Here, the cam pieces 18 and 20 can also be shifted in the first direction and in the second direction by means of the actuator 26 via the form-fit elements 38 and 40. The respective form-fit element 38 or 40 has a respective receiver 48 or 50.

Figure 2:
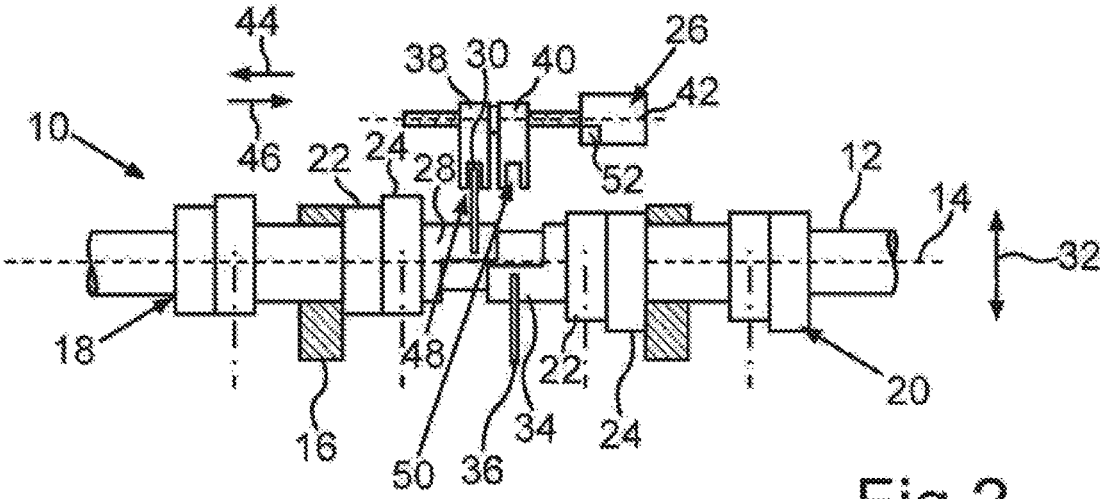
FIG. 2, sectionally, is a schematic side view of the valvetrain, wherein a first of the cam pieces is in its second position and the second cam piece is in its first position.
Figure 3:
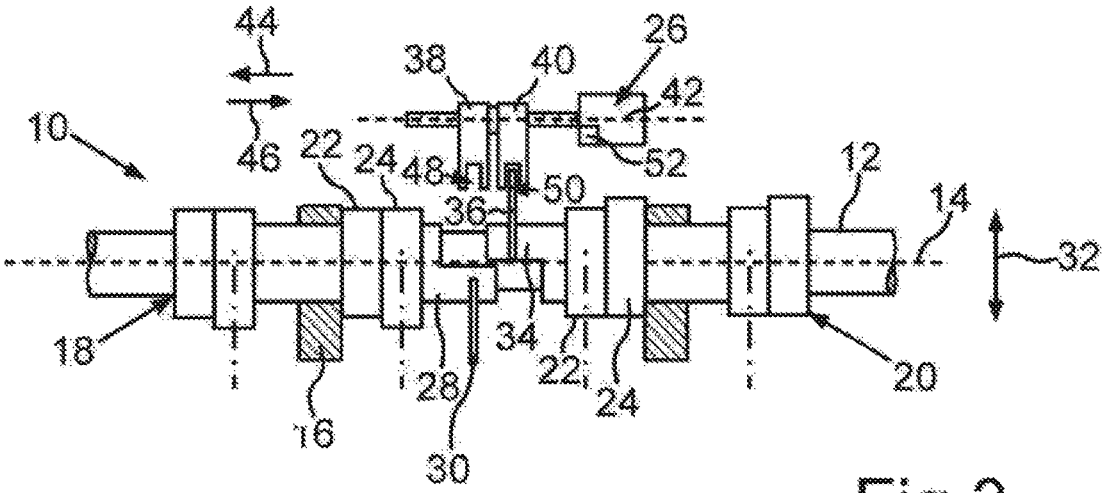
FIG. 3, sectionally, is a further schematic side view of the valvetrain, wherein the first cam piece is in the second position and the second cam piece is in the first position.
Figure 4:
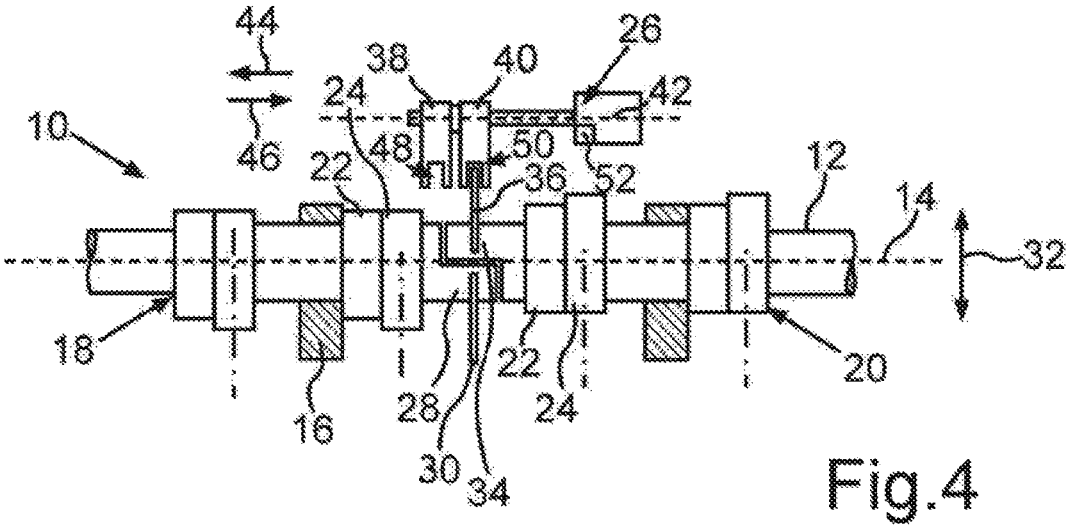
FIG. 4, sectionally, is a schematic side view of the valvetrain, wherein the cam pieces are in their respective second position.

The form-fit elements 38 and 40 can here be translationally moved, i.e., shifted, together by means of the actuator 26 in the movement direction between a first position shown in FIG. 1, a second position shown in FIGS. 2 and 3 and a third position shown in FIG. 4. Here, the actuator 26 comprises an engine 52 in particular schematically depicted in the Figures and common to the ribs 30 and 36 and the form-fit elements 38 and 40, by means of which engine the form-fit elements 38 and 40 or the cam pieces 18 and 20 can be shifted. Thus, the engine 52 is an engine common to the form-fit elements 38 and 40 or the cam pieces 18 and 20.

FIG. 1 shows a starting state in which the cam pieces 18 and 20 are in their first positions, and the form-fit elements 38 and 40 are in their first sliding position. If the cam pieces 18 and 20 are simultaneously in the first positions, then the first rib 30 interacts in a form-fit manner with the first form-fit element 38 during the first part and the second rib 36 does so during the second part, and a form-fit interaction of the ribs 30 and 36 with the second form-fit element 40 ceases during the rotation, in particular while the form-fit elements 38 and 40 are in their first sliding position. The respective rib 30 or 36 here interacts in a form-fit manner with the form-fit element 38 in such a way that the respective rib 30 or 36 engages in the recess 48 during the respective part. In the starting state, the gas exchange valves are actuated by means of the cam 22, since the cam pieces 18 and 20 are in their first positions. While the rib 30 interacts with the form-fit element 38 and thus with the actuator 26 by the rib 30 engaging in the recess 48, the form-fit elements 38 and 40 are shifted from the first sliding position into a respective second shifting position by means of the actuator 26, in particular by means of the engine 52, wherein the form-fit elements 38 and 40 are shifted to the left by means of the actuator based on the respective image plane of FIG. 1 or 2. Since the cam piece 18 is coupled to the actuator 26 via the rib 30 and the form-fit element 38, the cam piece 18 is shifted together with the form-fit elements 38 and 40, whereby the cam piece 18 is shifted out of its first position into its second position shown in FIG. 2, while a shifting, caused by the actuator, of the cam piece 20 ceases. In order to shift the form-fit elements 38 and 40 from the first sliding position into the second sliding position, the form-fit elements 38 and 40 are shifted together in the first direction by means of the actuator 26, in particular by means of the engine 52.

FIG. 2 shows a first intermediary state, in which the cam piece 18 is in its second position, while the cam piece 20 is in its first position. Furthermore, it can be seen in FIG. 2 that the cam piece 18 is shifted from the first position into the second position, while the cam piece 18 interacts with the actuator 26 via the rib 30 by the rib 30 engaging in the form-fit element 38 or in its recess 48. Here, the rib 36 engages neither in the form-fit element 38 nor in the form-fit element 40, such that the cam piece 20 is decoupled from the actuator 26, while the cam piece 18 is coupled to the actuator 26 via the rib 30.

FIG. 3 shows a second intermediary state following the first intermediary state shown in FIG. 2, in which the cam piece 18 is still in the second position and the cam piece 20 is still in the first position. The difference between the first intermediary state and the second intermediary state is that the camshaft 12 has rotated further in the second intermediary state in comparison to the first intermediary state, in particular by a half rotation, such that, in the first intermediary state, the cam piece 18 is coupled to the actuator 26 via the rib 30 and the cam piece 20 is decoupled from the actuator 26, wherein, in the second intermediary state, the cam piece 20 is connected to the actuator 26 via the rib 30 and the cam piece 18 is decoupled from the actuator 26. In other words, in the second intermediary state, the rib 36 engages in the form-fit element 40, in particular in the recess 50, such that, in the second intermediary state, the cam piece 20 is coupled to the actuator 26 via the rib 36 and the form-fit element 40, while the cam piece 18 is decoupled from the actuator 26. In the second state, i.e., while the cam piece 20 is coupled to the actuator 26 via the rib 36 and the cam piece 18 is decoupled from the actuator 26, the form-fit elements 38 and 40 are shifted further in the first direction and, in doing so, from the second sliding position into a third sliding position by means of the actuator 26, in particular by means of the engine 52. Since here the cam piece 20 is coupled to the form-fit element 40 and thus to the actuator 26 via the rib 36, the cam piece 20 is shifted together with the form-fit elements 38 and 40, whereby the cam piece 20 is shifted from its first position into its second position shown in FIG. 4.

FIG. 4 thus shows an end state, in which the two cam pieces 18 and 20 are simultaneously in the second positions. The end state is a second starting state, starting from which the cam pieces 18 and 20 can be moved back into the first starting state shown in FIG. 1 by means of the actuator 26, in particular via the second intermediary state and via the first intermediary state. For this, the form-fit elements 38 and 40 are shifted in the second direction by means of the actuator 26, in particular by means of the engine 52 and thus moved back from the third sliding position via the second sliding position into the first sliding position.

Overall, it can be seen in FIGS. 1 to 4 that, while the cam shaft 12 is rotated around the axis of rotation 14, firstly the rib 30, for example, comes into engagement with the form-fit element 38, whereby the cam piece 18 is shifted from the first position into the second position by means of the actuator 26, while a shifting of the cam piece 20 ceases. If the camshaft 12 is further rotated, then the rib 30 comes out of engagement with the form-fit element 38, and the rib 36 comes into engagement with the form-fit element 40, such that then the cam piece 20 can be shifted out of the first position into the second position by means of the actuator 26. If the cam pieces 18 and 20 are then simultaneously in the second positions, then the gas exchange valves are actuated by means of the cam 24.

The actuator 26 is, for example, a linear actuator, by means of which the form-fit elements 38 and 40 can be shifted in the movement direction. Furthermore, it is conceivable that the engine 52 is a rotary engine which has, for example, a rotor that can be rotated around the movement direction 42. A threaded spindle, for example, can be driven by means of the rotor and thus can be rotated around the movement direction 42, wherein the form-fit elements 38 and 40, for example, are screwed onto the threaded spindle. Furthermore, the form-fit elements 38 and 40, for example, are secured against a rotation around the movement direction, such that a relative rotation of the threaded spindle between the threaded spindle and the form-fit elements 38 and 40 is converted into a translational movement of the form-fit elements 38 and 40 in the movement direction 42. If thus the rotor and thus the threaded spindle, for example, are rotated in a first direction of rotation, then the form-fit elements 38 and 40 are shifted in the first direction, for example. If, for example, the rotor and thus the threaded spindle are rotated in a second direction opposite to the first direction of rotation, then the form-fit elements 38 and 40, for example, are shifted in the second direction. In this way, the cam pieces 18 and 20 can be shifted forwards and backwards in the movement direction, i.e., in the first direction and in the second direction, by means of the common engine 52.

Overall, it can be seen that, when the cam pieces 18 and 20 are simultaneously in the first positions, the first rib 30 interacts in a form-fit manner with the first form-fit element 38 during the first part and the second rib 36 does so during the second part, and a form-fit interaction of the ribs 30 and 36 with the second form-fit element 40 ceases during the rotation. When the cam pieces 18 and 20 are simultaneously in the second positions, the first rib 30 interacts in a form-fit manner with the second form-fit element 40 during the first part and the second rib 36 does so during the second part, and a form-fit interaction of the ribs 30 and 36 with the first form-fit element 38 ceases during the respective rotation. If the first cam piece is in its first position and if the second cam piece is simultaneously in its second position, the first rib interacts with the first form-fit element during the first part, the second rib interacts with the second form-fit element during the second part, a form-fit interaction of the first rib with the second form-fit element ceases during the rotation and a form-fit interaction of the second rib 36 with the first form-fit element 38 ceases during the rotation.

Furthermore, it can be seen that the two ribs 30 and 36, for example formed as crescent ribs, can be formed to be very narrow in the axial direction, whereby they require only a small construction space on the camshaft 12. Thus, the valvetrain 10 can also be used in such cylinder heads or internal combustion engines, which have a very small cylinder spacing. Moreover, a production of cost-intensive switching connecting links in the cam pieces 18 and 20 can be avoided, such that the valvetrain 10 can be produced cost-effectively.

The invention claimed is:

1. A valvetrain for an internal combustion engine, the valvetrain comprising:

a camshaft (12) configured to rotate about an axis of rotation (14);

a first cam piece (18) rotationally fixed on the camshaft (12), the first cam piece (18) including at least two cams (22, 24) configured to alternately actuate a first gas exchange valve;

a second cam piece (20) rotationally fixed on the camshaft (12), the second cam piece (20) including at least two cams (22, 24) configured to alternately actuate a second gas exchange valve; and an actuator (26) wherein configured to axially shift the first and second cam pieces (18, 20) relative to the camshaft (12);

wherein the first cam piece (18) further includes a radially outwardly protruding first rib (30) which extends circumferentially about the first cam piece (18) and entirely within a first angle region corresponding to a first half rotation of the camshaft (12);

wherein the second cam piece (20) further includes a radially outwardly protruding second rib (36) which extends circumferentially about the second cam piece (20) and entirely within a second angle region corresponding to a second half rotation of the camshaft (12);

wherein the actuator (26) engages the first rib (30) and is disengaged from the second rib (36) during the first half rotation so as to axially shift the first cam piece (18); and wherein the actuator (26) engages the second rib (36) and is disengaged from the first rib (30) during the second half rotation so as to axially shift the second cam piece (20).

2. The valvetrain according to claim 1, wherein the first and second cam pieces (18, 20) are each configured to axially shift between a respective first position and a respective second position.

3. The valvetrain according to claim 2, wherein the first and second cam pieces (18, 20) are sequentially shifted from the respective first position into the respective second position within one rotation of the camshaft (12).

4. The valvetrain according to claim 2, wherein the first and second ribs (30, 36) are aligned on a common first plane that extends perpendicular to the camshaft (12) when the first and second cam pieces (18, 20) are simultaneously in the respective first position, wherein the first and second ribs (30, 36) are aligned on a common second plane that extends perpendicular to the camshaft (12) when the first and second cam pieces (18, 20) are simultaneously in the respective second position, and wherein the second plane is axially spaced apart from the first plane relative to the camshaft (12).

5. The valvetrain according to claim 4 further wherein:

the actuator (26) is configured to engage the first and second ribs (30, 36) via a first form-fit element (38) and a second form-fit element (40);

when the first and second ribs (30, 36) are aligned on the first plane, the first form-fit element (38) is configured to receive the first rib (30) during the first half rotation and to receive the second rib (36) during the second half rotation;

when the first and second ribs (30, 36) are aligned on the second plane, the second form-fit element (40) is configured to receive the first rib (30) during the first half rotation and to receive the second rib (36) during the second half rotation; and when the first cam piece (18) is in the respective first position and the second cam piece (20) is simultaneously in the respective second position, the first form-fit element (38 is configured to receive the first rib (30)

during the first half rotation and the second form-fit element (40) is configured to receive the second rib (36) during the second half rotation.

6. The valvetrain according to claim 5, wherein the actuator (26) includes an engine (52) configured to drive the actuator (26).

7. The valvetrain according to claim 1, wherein the actuator (26) includes an engine (52) configured to drive the actuator (26).

8. The valvetrain according to claim 1, wherein the first rib extends more than 90 degrees about the first cam piece within the first angle region, and the second rib extends more than 90 degrees about the second cam piece within the second angle region.

* * * * *